US012543862B2

(12) United States Patent
Rom

(10) Patent No.: US 12,543,862 B2
(45) Date of Patent: Feb. 10, 2026

(54) UPHOLSTERED-FURNITURE ARRANGEMENT WITH UPHOLSTERY-FIRMNESS ADJUSTMENT, AND USE THEREOF

(71) Applicant: SENSOO SA, Eupen (BE)

(72) Inventor: Stephan Rom, Eupen (BE)

(73) Assignee: SENSOO SA, Eupen (BE)

( * ) Notice: Subject to any disclaimer, the term of this patent is extended or adjusted under 35 U.S.C. 154(b) by 261 days.

(21) Appl. No.: 18/035,957

(22) PCT Filed: Nov. 12, 2021

(86) PCT No.: PCT/EP2021/081579
§ 371 (c)(1),
(2) Date: May 9, 2023

(87) PCT Pub. No.: WO2022/101441
PCT Pub. Date: May 19, 2022

(65) Prior Publication Data

US 2024/0237830 A1 Jul. 18, 2024

(30) Foreign Application Priority Data

Nov. 13, 2020 (DE) ..... 10 2020 214 331.5

(51) Int. Cl.
*A47C 7/14* (2006.01)
*A47C 7/30* (2006.01)
(Continued)

(52) U.S. Cl.
CPC ..... *A47C 23/0435* (2013.01); *A47C 7/14* (2013.01); *A47C 7/30* (2013.01); *A47C 7/345* (2013.01); *A47C 17/02* (2013.01); *A47C 23/16* (2013.01)

(58) Field of Classification Search
CPC ..... A47C 7/14; A47C 7/30; A47C 7/462
See application file for complete search history.

(56) References Cited

U.S. PATENT DOCUMENTS 2,717,029 A * 9/1955 Jonas ..... A47C 23/30 267/89
3,323,835 A * 6/1967 Barecki ..... B60N 3/02 297/452.2
(Continued)

FOREIGN PATENT DOCUMENTS

CN 201001530 Y * 1/2008 ..... A47C 7/462
CN 101528086 A * 9/2009 ..... A47C 7/28
(Continued)

*Primary Examiner* — Timothy J Brindley
(74) *Attorney, Agent, or Firm* — Miller, Canfield, Paddock and Stone

(57) ABSTRACT

It is of interest to be able to adjust the upholstery firmness of furniture for sitting and lying on as individually as possible, in particular with a view to being able to use the furniture for a long time. In addition, there is a need for a design which allows firmness adjustment to be integrated and which can be realized as flexibly as possible for different furniture or seat variants. The invention provides an upholstered-furniture arrangement (100) which has a basic frame (7) and an upholstered cushion (6) on which someone can sit or lie, which is fixed to the basic frame at least in the edge region thereof and which has a panel (4) beneath it for upholstery-firmness adjustment, the panel being arranged in the basic frame (7) such that the height of the panel can be adjusted by pivoting the panel, wherein the end of the panel (4) located opposite a pivot shaft (14) is arranged freely in the basic frame (7), and a height-adjustment device acts on the panel (4) from beneath by applying an adjustable compressive/prestressing force (F), the height-adjustment device being supported in the downward direction by the basic frame, counter to the compressive/prestressing force. This arrangement has an attractive, direct technical effect and offers a good compromise between cost and benefit.

18 Claims, 4 Drawing Sheets

(51) Int. Cl.

| | |
|---|---|
| ***A47C 7/34*** | (2006.01) |
| ***A47C 17/02*** | (2006.01) |
| ***A47C 23/043*** | (2006.01) |
| ***A47C 23/16*** | (2006.01) |

(56) References Cited

U.S. PATENT DOCUMENTS

| | | | | | |
|---|---|---|---|---|---|
| 4,893,872 | A * | 1/1990 | Sugai | A47C 7/462 | 297/284.8 |
| 5,601,338 | A * | 2/1997 | Wahls | B60N 2/504 | 297/452.55 |
| 8,683,629 | B2 * | 4/2014 | Clenet | A61G 7/015 | 5/616 |
| 2007/0214571 | A1 * | 9/2007 | Piraino | A47C 27/065 | 5/616 |
| 2020/0187659 | A1 * | 6/2020 | Chang | A47C 7/024 | |
| 2022/0117396 | A1 * | 4/2022 | Taylor | A47C 1/03288 | |

FOREIGN PATENT DOCUMENTS

| | | | | | |
|---|---|---|---|---|---|
| CN | 112545232 | A * | 3/2021 | A47C 7/462 | |
| CN | 115088974 | A * | 9/2022 | | |
| CN | 117547121 | A * | 2/2024 | | |
| CN | 118844764 | A * | 10/2024 | | |
| DE | 20202222 | | 6/2002 | | |
| DE | 202013009039 | U1 * | 2/2015 | A47C 7/18 | |
| EP | 1716791 | | 11/2006 | | |
| KR | 100427193 | B1 * | 4/2004 | | |
| KR | 100809265 | B1 * | 3/2008 | | |
| KR | 102692911 | B1 * | 8/2024 | | |
| KR | 102701158 | B1 * | 9/2024 | | |
| KR | 20240141376 | A * | 9/2024 | | |

* cited by examiner

UPHOLSTERED-FURNITURE ARRANGEMENT WITH UPHOLSTERY-FIRMNESS ADJUSTMENT, AND USE THEREOF

TECHNICAL FIELD

The present invention relates to an upholstered furniture device having a base frame and a seat/couch cushion which is fixed thereto at least in the edge region and, for the purpose of adjusting the cushion hardness, is engaged underneath by a plate which is arranged in the base frame so as to be pivotably adjustable in height. In particular, the invention relates to cushion hardness adjustments for seating furniture and sleeping furniture. Last but not least, the present invention also relates to the use of a pivoting kinematic system operable by means of a screw manipulator for providing the upholstery hardness adjustment. In particular, the invention relates to a device and uses according to the generic term of the respective independent claim.

BACKGROUND OF THE INVENTION

For good comfort of seating and reclining furniture or upholstered furniture in general, hardness adjustment is advantageous, for example in car seats. Weight and height, fitness, anatomy of the back and buttocks are just a few individual characteristics that lead to an individual perception of comfort. In many situations, therefore, individuals want to be able to maximize their own comfort sensation through customizable settings, e.g., during a long-distance trip in a passenger car, or during long evenings watching television. A complicating factor for manufacturers of upholstered furniture is the fact that even seating/reclining furniture is nowadays often selected and purchased online, or with little leisure for selection and decision-making in the local retail store. Effect: In many cases, the customer or end consumer has chosen a piece of seating/reclining furniture with upholstery whose hardness does not meet the individual comfort requirements. Unfortunately, this only becomes apparent after a certain period of use.

The utility model specification DE 202 02 222 U1 describes a seat hardness adjustment device for a type of upholstered furniture having a base frame and a seat or reclining cushion fixed thereto at least in the edge region, which cushion is gripped by a base plate for seat hardness adjustment, which base plate is arranged in a height-adjustable manner in the base frame. This upholstered furniture is characterized in that the base plate is hinged in the underframe on one side so as to be pivotable about a horizontal pivot axis, while the opposite end is coupled to a height adjustment device in the underframe, and in that
on the base plate, an elevation attachment body is provided projecting on the top side, which engages under the cushion or ends at a defined distance below it, whereby the elevation attachment body limits the pushing through of the cushion or compresses the cushion against the fixed and tensioned cover according to the adjustment height of the base plate.

The technical solutions described in the state of the art have probably not yet reached the end of innovations, especially with regard to ergonomics, manual adjustability, constructive complexity and/or necessary function/design compromises. Product improvements still seem possible. Based on the state of the art, there is interest in a hardness adjustment option for upholstered furniture that enables an even better symbiosis of the requirements mentioned above.

SUMMARY OF THE INVENTION

The task is to provide a device with which the upholstery hardness of seating/reclining furniture can be adjusted in a particularly simple and cost-effective manner, or with which an upholstery hardness adjustment can be realized in a particularly simple manner, in particular while maintaining structural free space.

This task is solved by an upholstered furniture device according to claim 1 as well as by uses according to the respective adjacent use claim. Advantageous further embodiments of the invention are explained in the respective subclaims. The features of the embodiments described below can be combined with one another, unless this is explicitly negated.

Provided is an upholstered furniture device with a base frame and a seat/lounger cushion fixed thereto at least in the edge region, which cushion is engaged underneath by a plate for cushion hardness adjustment, which plate is arranged in the base frame so as to be pivotably adjustable in height, in that the plate is articulated in the base frame so as to be pivotable on one side about a horizontal pivot axis, wherein an elevation attachment body is provided projecting on the upper side on the plate, which elevation attachment body engages underneath the seat/lounger cushion or ends at a defined distance below it, wherein the elevation attachment body limits the pushing through of the seat/lounger cushion or compresses the seat/lounger cushion against a fixed and tensioned cover of the seat/lounger cushion in accordance with the height adjustment height of the plate.

According to the invention, it is proposed that the plate is arranged with its end opposite the swivel axis exposed in the base frame, and that a height adjustment device acts on the plate from below with an adjustable compression/pretension force, the height adjustment device being supported downwards in the base frame against the compression/pretension force. This not only provides design freedom, especially also with regard to a retrofit option or variation of the hardness adjustment, but also a particularly simple, direct, easily adjustable and cost-effective mechanism.

It has been shown that mounting the plate with an exposed end is also advantageous with regard to the forces acting and to the transmission of the forces. The design according to the invention also provides the following advantages: low space requirement of the adjustment mechanism; material saving, in particular with regard to one/the plate(s);

According to one embodiment, a force application point of the height adjustment device on the panel is/are defined by the arrangement of a crossbar of the base frame, on which the height adjustment device is counter-supported in order to transmit the forces transmitted downwards from the seat/reclining cushion into the base frame. The exact position of the crossbar can be optimized not only with regard to the position of the force transmission point (pressure point), but also depending on the design of the furniture.

According to one embodiment, the height adjustment device defines a lever in relation to the swivel axis which is smaller in length than the corresponding extension of the plate, in particular 1-65% smaller. This also enables a comparatively slim design, with minimized material usage.

According to one embodiment, the height adjustment device has a manually operated adjustment means for adjusting the height position of the plate and for adjusting the pressure force, in particular a screw supported in/in a crossbeam arranged under the plate. This can further facilitate the adjustment, in particular also without any kind of motorized assistance.

According to an embodiment example, one/the manually operable adjustment means of the height adjustment device has a free end by means of which a/the force application point is/are defined for transmitting the compression/pretensioning force from below to the panel. This also provides comparatively large design freedom or variation possibilities in the height direction, e.g. with regard to a more or less pronounced cushion thickness.

According to one embodiment, the plate is made of a comparatively hard material, whereby a manually operated adjusting means acts directly on the plate with its free end to transmit the compressive/preload force from below to the plate. This also provides a particularly slim design in terms of the number of parts.

Optionally, the plate is made of a comparatively soft material, with a free end of a/the manually operable adjustment means being defined by a spherical head with an enlarged bearing surface and/or reinforced by an interposed pressure distribution element and coupled to the underside of the plate. This also makes it possible to set the requirements for the rigidity of the plate at a lower level.

According to an embodiment example, the arrangement of the height adjustment device, in particular of at least one manually operable adjustment means of the height adjustment device, is at least approximately central in the transverse direction or eccentric to at least one side, in particular with an eccentricity in only one direction and optimized in terms of amount for ergonomic handling by a person using the upholstered furniture device. This also enables an ergonomic adjustment. Thanks to the very simple and cost-effective design structure of the height adjustment device according to the invention, adjustment means arranged eccentrically in the transverse direction on both sides, in particular star knobs with screws, can also be optionally provided, in particular for a seat, in particular for a vehicle seat. This also enables an ergonomically optimized, yet quite cost-effective concept.

According to an embodiment example, the seat/lounger cushion has at least two spring units, namely a first spring unit in the form of an upper cushion made of a flexible material, and at least one further spring unit arranged underneath, on which a compressive/pre-tensioning force exerted upwards by the plate acts, in particular with the further spring unit comprising wave springs. This also enables a particularly homogeneous pressure distribution, while also allowing a flexible response to individual upholstery and comfort requirements.

According to an embodiment example, an underpadding is provided on the panel, in particular provided by the elevation attachment body, especially with a protective cover, in particular over a section of only a maximum of 50% of the seating/lying surface. This enables further material savings, in particular thanks to material used locally in a very targeted manner in the corresponding effective section.

The aforementioned task is also solved by using a swivel kinematic system operable by means of a screw manipulator for providing a hardness adjustment for an upholstered furniture device, in particular for an upholstered furniture device described further above, wherein the screw manipulator for exerting a still upwardly directed pressure/preloading force is/are arranged with a lever to the pivot axis which is shorter than the seat/lying surface of the upholstered furniture device to be adjusted, wherein the pivot kinematics for providing a hardness adjustment for an upholstered furniture device in the form of a seat is used, in particular for a vehicle. This results in previously mentioned advantages, in particular with regard to an application by a driver or passenger of a motor vehicle.

The aforementioned task is also solved by using a pivoting kinematic system, which can be actuated by means of a screw manipulator, for providing a hardness setting for an upholstered furniture device, in particular for an upholstered furniture device described above, wherein the screw manipulator is coupled to a transverse beam for exerting an upwardly directed compression/pretension force, which transverse beam is supported on the lateral plan of a base frame of the upholstered furniture device, wherein the transverse beam is arranged at a lever distance from the pivot axis which is at least 20%, preferably at least 30%, shorter than the seat/lying surface of the upholstered furniture device to be adjusted, wherein the pivot kinematics is used for providing a hardness adjustment for an upholstered furniture device in the form of a sofa or reclining furniture, in particular for stationary use in a property. This results in previously mentioned advantages, in particular also for use in the private sector.

The design and kinematic concept according to the invention results in the aforementioned advantages, particularly with regard to a cost-effective retrofit option for existing seating/reclining furniture.

BRIEF DESCRIPTION OF THE DRAWINGS

The invention is described in further detail in the following drawing figures, with reference being made to the other drawing figures for reference signs that are not explicitly described in a respective drawing figure. Showing.

DETAILED DESCRIPTION OF THE INVENTION

Figure 1:
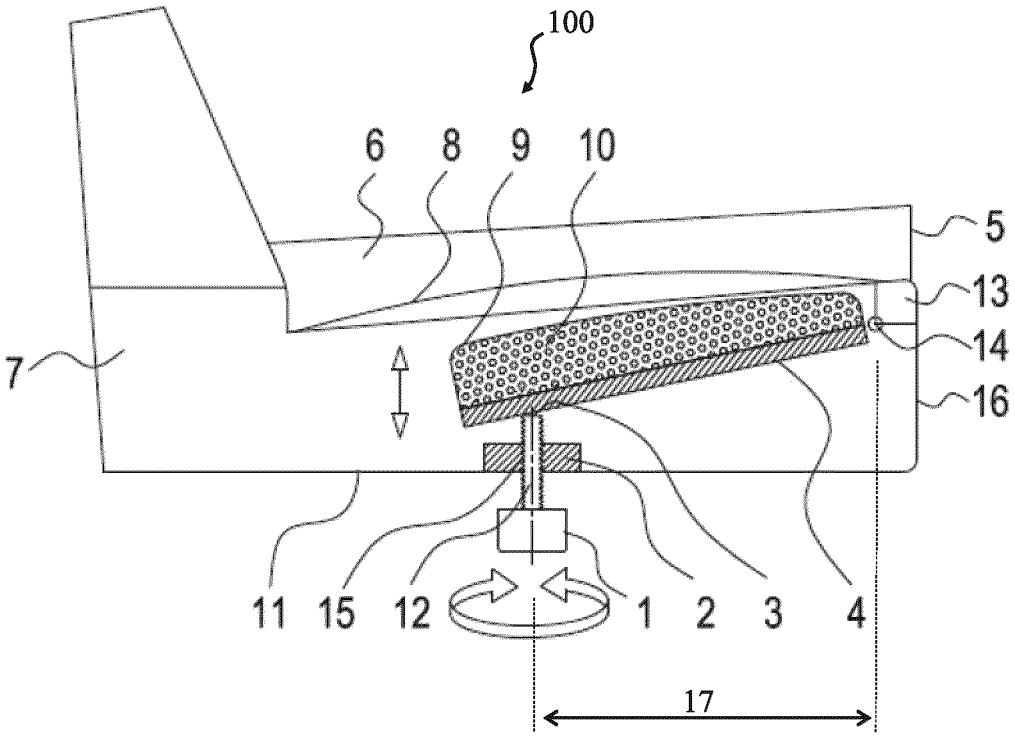
FIG. 1 in a cut side view an upholstered furniture device according to an embodiment example.

The invention is first described in general terms with reference to all reference signs. Details are explained in connection with the respective figure.

An upholstered furniture device 100 has a manual adjustment 1 (manipulator), in particular a star knob, by means of which an upwardly directed pressure/pretensioning force F can be exerted on a panel 4 (in particular board). The adjustable manipulator 1 is mounted on a crossbar 2 (in particular batten), which is supported in a base frame 7 (in particular frame) of the upholstered furniture device 100. The point of application of force 3 (in particular pressure point or bearing surface for screw) defined by the manipulator 1 is arranged relative to a pivot axis of the plate 4 (pivot bearing 14, in particular hinge) in a lever 17 (lever arm) which is shorter than the length of the plate 4, so that the plate 4 has a free end which is not hinged. The comparatively short lever also allows direct force transmission largely without bending moments/bending forces, in particular direct force transmission at least approximately in the area of the main pressure point or the greatest pressure forces of a user of the furniture.

The upholstered furniture device 100 has a seat/reclining cushion 6 or an upper cushion (first spring unit), which can be protected from heavy wear by upper material 5, in particular upholstery cover. The upper cushion 6 preferably comprises at least one spring material/element from the group: foam, springs, spring core, absorbent cotton, compliant/elastic materials. At least one further (second) spring unit 8 (in particular with at least one spring material/element from the group: wooden slats, rubber belts, wave springs) is arranged under the top cushion 6, i.e. between the top cushion 6 and the board 4. A cushioning covering can also be provided on the board 4, in particular an under padding 10 (in particular consisting of at least one cushioning material from the group: foam, rubber, springs, compliant/elastic materials), which in turn can be protected from heavy mechanical wear by a protective device 9 (in particular protective cover/layer). The at least one transverse beam 2 is supported on a lateral plan 11 (in particular on opposite side cheeks of the base frame).

At least one adjusting means 12, in particular a screw, is provided for adjusting the hardness, the adjusting means 12 being supported by a positive/positive coupling 15 (in particular via a thread/thread block) in the crossbeam 2. A batten or a crossbeam 13 can be provided as a bearing for the swivel axis 14, which in turn can be supported on an end face 16 of the base frame.

With reference to the figures, the invention may also be described as follows:

A star knob 1 is attached to a screw 12, which is guided through a thread 15, which is centrally attached to a batten 2, which is fixed to the outer sides or underside of the frame 7. The upper part of the screw is self-locking in such a way that the screw 12 cannot be turned out of the thread 15. The damping body comprises a board 4, a padding 10 fixed to the board, and a protection 9 for either the padding 10 or the spring material 8, the protection 9 preventing the spring material 8 from damaging or wearing away the padding material 10. The cushioning body is fixed on one side by a flexible profile or hinge or the like pivot bearing 14 to a batten 13, which is fixed to the outer sides of the frame 7. Above the spring material 8 is the padding 6, which is covered with the cover 5.

For handling, the upholstery hardness can be adjusted by a construction in the frame of the upholstered furniture. For greater hardness, a screw 12 attached to a star knob 1 can be manipulated for ease of handling. The comfort becomes softer when the screw 12 is turned out (continuous reduction of compression/preload force), so that the spring travel of the spring materials 6, 8 becomes more unrestricted. To build up the compressive force, the screw can be turned in (restriction of the spring travel of the spring materials, shorter damping travel).

For the materials that can be used, the following possibilities can be listed (not exhaustive):

The bottom padding 10 may include, for example, foam, rubber, springs, and the like yielding materials. The seat/reclining cushion (upper cushion, first spring unit) 6 may comprise, for example, foam, springs, spring cores, absorbent cotton and the like yielding materials. The further spring unit 8 may comprise, for example, wooden slats, rubber belts, wave springs or the like.

The advantages of the invention can also be summarized as follows:

The pressure force-based adjustment mechanism requires little space, so that greater degrees of freedom are created with regard to design and further functional integration into the furniture. The furniture can also be easily assembled, which facilitates the provision of the upholstered furniture device or components thereof, particularly with regard to transport in boxes (facilitated shipping).

The plate 4 preferably has a length (extension longitudinally, i.e. orthogonally to the transverse direction) between ⅓ and the entire area of the spring material 8. This leads to material and cost and weight savings (smaller required area), and also to more freedom in design. The plate 4 has a free end which does not need to be hinged. In this respect, the length of the plate 4 can also be adapted (in particular, kept maximally short) with regard to the particular type of furniture.

The screw 3 is preferably long enough so that, in the fully screwed-in position, it aligns the plate 4 between 60° and 110° relative to the front surface 16. This allows a noticeable adjustment of the seating comfort. The longer the screw, the greater the pivot angle adjustment that can be realized, and the greater the range of variation for cushion hardness. This relationship is plausible; it is also of interest and importance here that the adjustment range can be increased and adapted via a non-perceptible adjustment (length of the screw), in particular without cost effects or necessary design measures. This provides significant advantages, in particular also in comparison with the articulation of the plate on the edge opposite the swivel axis proposed in the prior art.

The plate width is preferably selected so that the entire spring material 8 (in particular Nosag springs) can be supported. This enables uniform hardness over the entire seat/lying surface.

The padding 10 of the panel need not be provided over the entire length of panel 4, but can also be provided, for example, only in the middle 50% of the seat depth (or middle 30% or middle 20% of the seat depth). In this case, it is not necessarily the case that the entire section (in particular 50 middle percent of the seat/reclining surface) must be covered with foam or similar compliant material, but alternatively only a section of the selected cushioned section can be provided with compliant material. Last but not least, this also allows the use of less material, in particular less but higher quality material (especially compared to a more inefficient variant with padding extending over the entire surface of the panel 4).

The invention is also based on the concept of having to provide as few components as possible, as many of which are also available as standard components (low-cost simple mechanism for a wide range of applications).

The control (manipulator 1) is preferably arranged in such a way that it is not visible (especially when the furniture is standing on its feet and is located in a living space), but that it nevertheless remains operable by a user in the intended position of use (e.g. when the user is sitting on the sofa). This provides both a functional and an aesthetic advantage.

Last but not least, the simplicity of the (structural) design of the device enables a high degree of stability, so that a particularly high load can be transmitted at the point of contact of the screw 3 between the plate 4 and the base frame. The arrangement of the force transmission point below the seating/lying surface (centrally or slightly eccentrically) also makes it possible to minimize bending moments, which not least also makes the hardness setting more independent of the material properties of the plate.

This has advantages not least in terms of long-term properties. Even if the board should be structurally weakened, e.g. due to permanently high humidity, the hardness setting can be ensured largely unaffected.

In the following, individual special features are highlighted in the respective figure.

FIG. 1 explains the entire design concept, illustrating the relative arrangement of the pressure point 3 relative to the pivot axis by the lever arm 17.

Figure 2A:
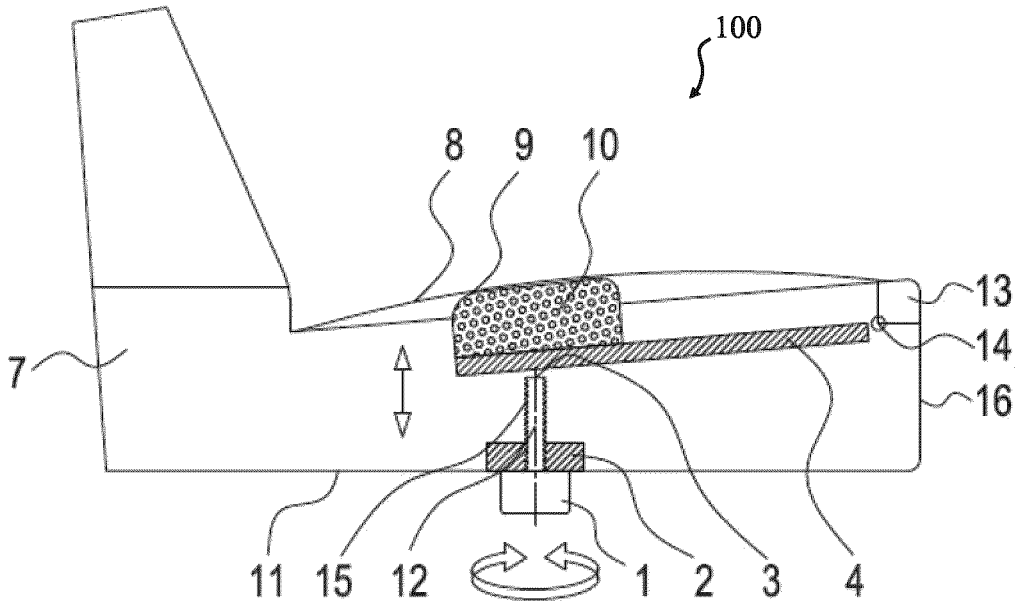
FIGS. 2A, 2B each in a cutaway side view in different hardness settings of an upholstered furniture device according to a further embodiment.
Figure 2B:
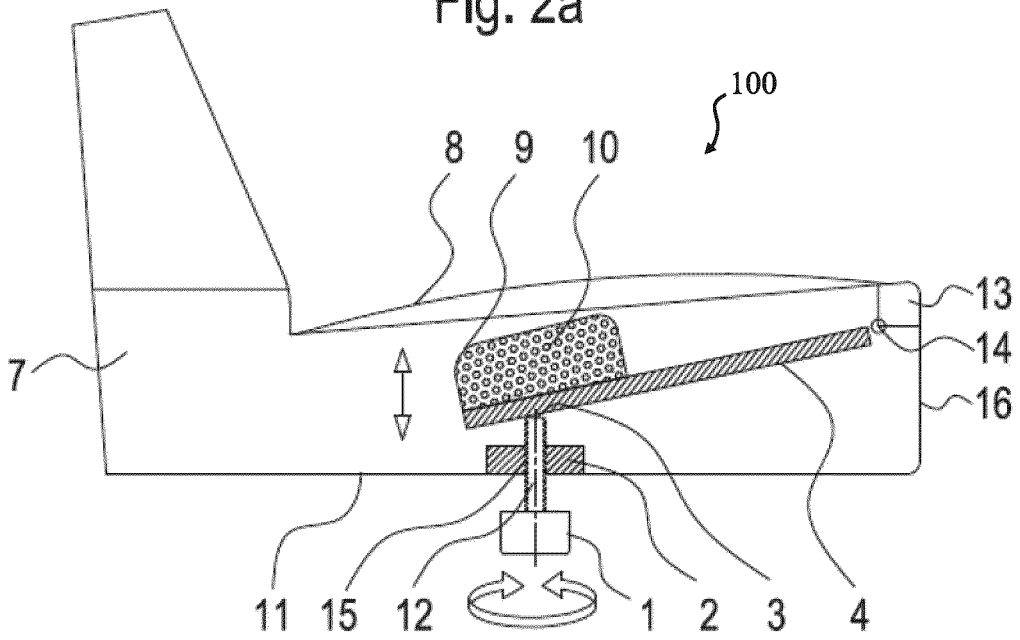

FIGS. 2A, 2B illustrate the path of movement or the displacement/swiveling direction. The hardness setting can be carried out in an ergonomically advantageous and also comparatively precise manner by means of a rotary movement. A manipulator 1 is shown here—optionally, the rotary movement can also be provided in a simple manner by an electric motor. The screw kinematics are also very low-maintenance and reliable in operation, in particular because no foreign bodies or the like can hinder locking or engagement.

Figure 3:
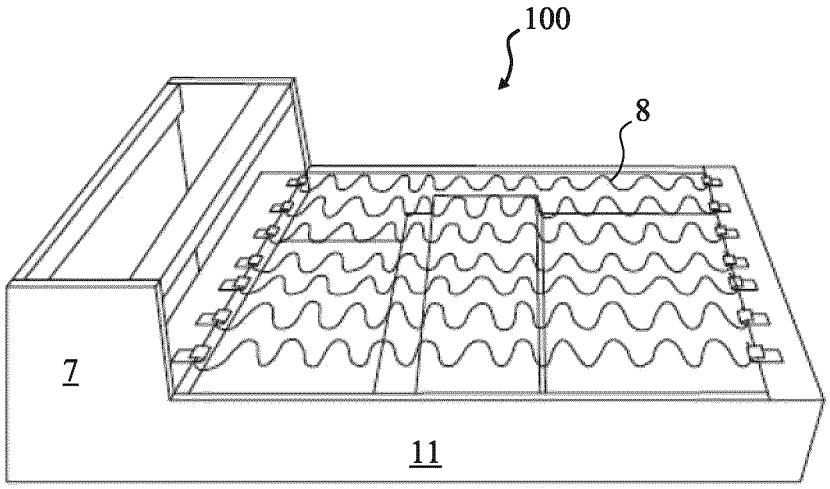
FIG. 3 in a perspective top view of a wave spring unit an upholstered furniture device according to an embodiment example.

FIG. 3 shows the relative arrangement of the bottom padding 10 relative to the wave spring 8 (namely below it).

Figure 4:
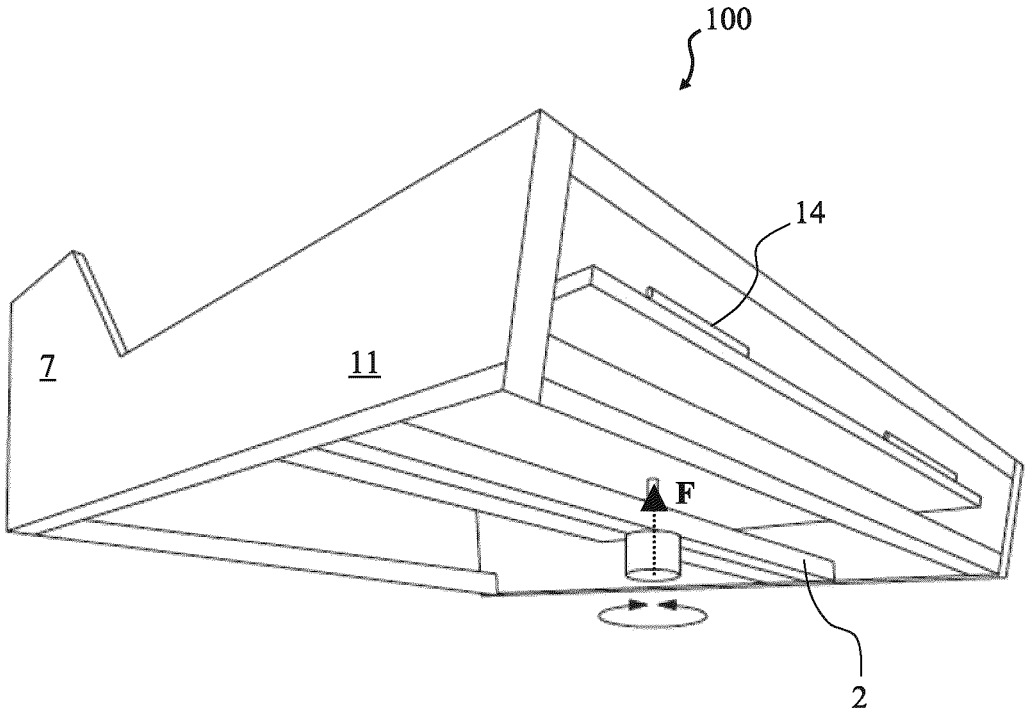
FIGS. 4, 5 and 6 each in a perspective view from below a variation with respect to the support/contact surface when exerting a compressive/biasing force of an adjustment means in an upholstered furniture device according to embodiments.
Figure 5:
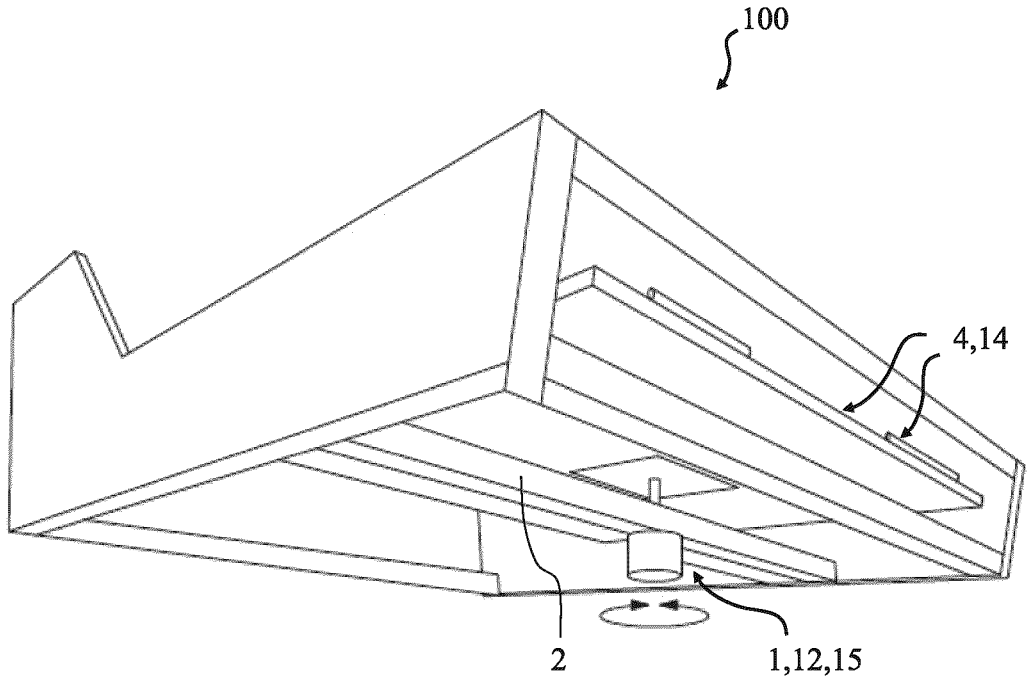
Figure 6:
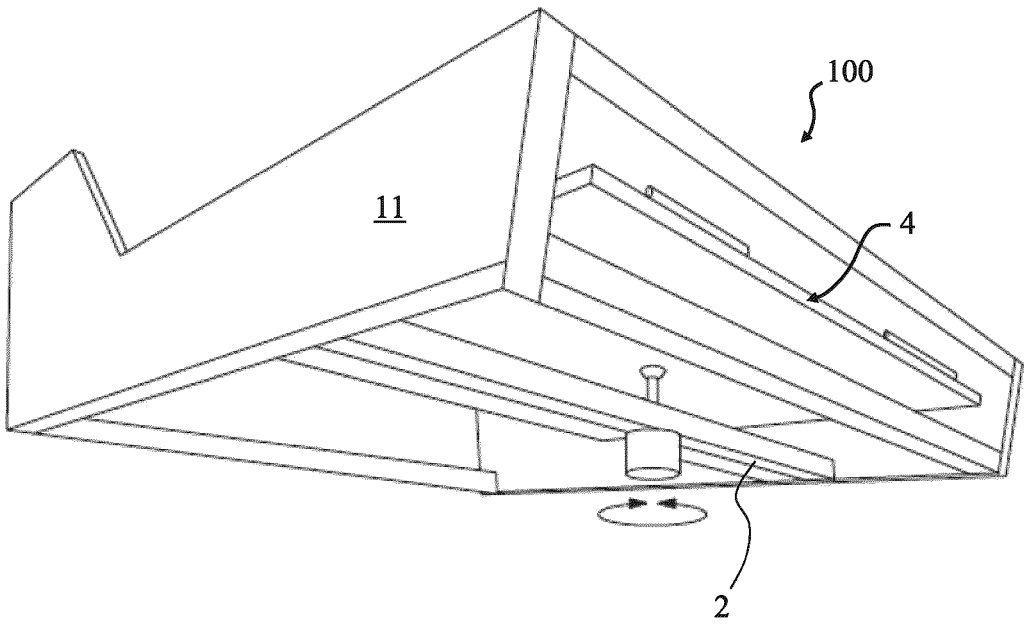

FIGS. 4, 5 and 6 illustrate three different variants with regard to the coupling of the height adjustment device to the plate at the force transmission point. Three options are described, which take into account different stable materials of the plate.

According to FIG. 4, the panel 4 is made of comparatively stable material, e.g. plywood, metal, solid wood, plastic, hard rubber or the like (in particular as distinguished from OSB, JSM, chipboard, cardboard or the like).

According to FIG. 5, the screw 3 has a ball joint (spherical head-like intermediate pressure distribution element) at the upper end with a bearing surface that is at least 1 $cm^2$ in size, and which can also be significantly larger (up to almost as large as the plate 4 itself). This allows the load to be distributed (minimizing the area-specific compressive force). In this way, comparatively inexpensive material can also be used (in particular OSB, JSM, chipboard or other wood-based materials).

According to FIG. 6, a flat interposed pressure distribution element is provided on the contact surface between the plate 4 and the screw 3 on the side of the plate 4 for reinforcement, in particular made of comparatively hard material (e.g. hard rubber, metal, plastic or the like). This variant also permits the use of comparatively inexpensive material for the plate 4.

FIG. 4 describes a part-reduced variant. FIG. 5 shows a variant optimized with regard to a force distribution over as large an area as possible (pressure minimization). FIG. 6 describes the optional use of an intermediate pressure distribution element.

In the figures, only one adjustment means 12 is shown on only one crossbeam 2. Depending on the size of the area to be upholstered, several adjustment means 12 can be provided on one or more crossbars 2. This scalability can also be realized as a further advantage of the invention, in particular thanks to the components of the hardness adjustment which can be provided in a particularly cost-optimized manner.

LIST OF REFERENCE SIGNS

1 manual adjustment (manipulator), especially star knob
2 Crossbar, especially lath
3 Force application point, in particular pressure point or contact surface for screw
4 Plate, especially board
5 Upper material, especially upholstery cover
6 Seat/reclining cushion or upper cushion (first spring unit), in particular cushioning with at least one spring material/element from the group: foam, springs, spring core, wadding, flexible/elastic materials
7 Base frame, especially frame
8 further (second) spring unit, in particular with at least one spring material/element from the group: wooden slats, rubber belts, wave springs (no-sag springs)
9 Protective device, in particular protective cover/layer on bottom upholstery.
10 Bottom padding, in particular consisting of at least one padding material selected from the group consisting of: foam, rubber, springs, resilient/elastic materials.
11 Lateral plan, especially sidewalls of the base frame
12 Adjustment means of the height adjustment device, in particular screw
13 Bearing for swivel axis, in particular lath or crossbeam
14 Swivel bearing, especially hinge
15 form-fit/force-fit coupling, especially thread/thread block in crossbeam
16 Front side of base frame, especially front panel
17 Lever
100 Upholstered furniture device
F Compressive/preload force

The invention claimed is:

1. An upholstered furniture device with a base frame and a seat/reclining cushion which is fixed thereto at least in the edge region and which, for the purpose of adjusting the hardness of the cushion, is engaged underneath by a plate which is arranged in the base frame so as to be pivotably adjustable in height, in that the plate is articulated in the base frame so as to be pivotable on one side about a horizontal pivot axis, wherein an elevation attachment body is provided on the plate projecting on the upper side, which elevation attachment body engages under the seat/lounger cushion or ends at a defined distance thereunder, wherein the elevation attachment body limits the pushing-through of the seat/lounger cushion or compresses the seat/lounger cushion against a fixed and tensioned cover of the seat/lounger cushion in accordance with the height adjustment height of the plate;

wherein the plate is arranged with its end opposite the pivot axis exposed in the base frame, and in that a height adjustment device acts on the plate from below with an adjustable pressure/pretensioning force, the height adjustment device being supported downwards in the base frame against the pressure/pretensioning force;

wherein the upholstered furniture device includes a pivoting kinematic system, which can be actuated by means of a screw manipulator, for providing a hardness adjustment for the upholstered furniture device in the form of a seat, in particular for a vehicle, wherein the screw manipulator is/are arranged for exerting an upwardly directed pressure/pretensioning force with a lever to the pivot axis, which is shorter than the seat/lying surface of the upholstered furniture device to be adjusted.

2. The upholstered furniture device according to claim 1, wherein a force application point of the height adjustment device at the plate is defined by the arrangement of a transverse beam of the base frame, at which the height adjustment device is counter-mounted for transmitting the forces transmitted downwardly from the seat/reclining cushion into the base frame.

3. The upholstered furniture device according to claim 1, wherein the height adjustment device defines a lever with respect to the pivot axis which is smaller in length than the corresponding extension of the plate, in particular 1-65% smaller.

4. The upholstered furniture device according to claim 1, wherein the height adjustment device comprises a manually operable adjustment means for adjusting the height position of the plate and for adjusting the pressure/pre-tensioning force, in particular a screw supported in/in a crossbar arranged under the plate.

5. The upholstered furniture device according to claim 1, wherein a manually operable adjusting means of the height adjustment device has a free end by means of which a force application point for transmitting the pressure/pre-tensioning force from below to the plate is/are defined.

6. The upholstered furniture device according to claim 1, wherein the plate is made of a comparatively hard material, and wherein a manually operable adjusting means acts with its free end directly on the plate for transmitting the pressure/pre-tensioning force from below to the plate: or wherein the plate is made of a comparatively soft material, and wherein a free end of the manually operable adjusting means is defined by a ball head with an enlarged bearing surface and/or is reinforced by an interposed pressure distribution element and coupled to the underside of the plate.

7. The upholstered furniture device according to claim 1, wherein the arrangement of the height adjustment device, in particular of at least one manually operable adjusting means of the height adjustment device, is at least approximately central in the transverse direction or eccentric to at least one side, in particular with an eccentricity in only one direction and optimized in terms of magnitude for ergonomic handling by a person using the upholstered furniture device.

8. The upholstered furniture device according to claim 1, wherein the seat/reclining cushion comprises at least two spring units, namely a first spring unit in the form of an upper cushion made of a resilient material, and at least one further spring unit arranged thereunder, on which a pressure/pre-tensioning force exerted upwardly by the plate acts, in particular with the further spring unit comprising wave springs.

9. The upholstered furniture device according to claim 1, wherein an underpadding is provided on the plate, in particular provided by the elevation attachment body, in particular with a protective cover, in particular over a section of only 50% maximum of the seating/lying surface.

10. An upholstered furniture device with a base frame and a seat/reclining cushion which is fixed thereto at least in the edge region and which, for the purpose of adjusting the hardness of the cushion, is engaged underneath by a plate which is arranged in the base frame so as to be pivotably adjustable in height, in that the plate is articulated in the base frame so as to be pivotable on one side about a horizontal pivot axis, wherein an elevation attachment body is provided on the plate projecting on the upper side, which elevation attachment body engages under the seat/lounger cushion or ends at a defined distance thereunder, wherein the elevation attachment body limits the pushing-through of the seat/lounger cushion or compresses the seat/lounger cushion against a fixed and tensioned cover of the seat/lounger cushion in accordance with the height adjustment height of the plate;

wherein the plate is arranged with its end opposite the pivot axis exposed in the base frame, and in that a height adjustment device acts on the plate from below with an adjustable pressure/pretensioning force, the height adjustment device being supported downwards in the base frame against the pressure/pretensioning force;

wherein the upholstered furniture device includes a swivel kinematic system, which can be actuated by means of a screw manipulator, for providing a hardness setting for the upholstered furniture device and wherein the screw manipulator is coupled to a transverse beam, which is supported on the lateral plan of a base frame of the upholstered furniture device, for exerting an upwardly directed pressure/pretensioning force; and wherein the height adjustment device defines a lever with respect to the pivot axis which is smaller in length than the corresponding extension of the plate, in particular 1-65% smaller.

11. The upholstered furniture device according to claim 10, wherein the transverse beam is arranged at a lever distance from the pivot axis which is at least 20%, preferably at least 30%, shorter than the seat/lying surface of the upholstered furniture device to be adjusted, wherein the pivot kinematics is used for providing a hardness adjustment for an upholstered furniture device in the form of a sofa or reclining furniture, in particular for stationary use in a property.

12. The upholstered furniture device according to claim 10, wherein a force application point of the height adjustment device at the plate is defined by the arrangement of a transverse beam of the base frame, at which the height adjustment device is counter-mounted for transmitting the forces transmitted downwardly from the seat/reclining cushion into the base frame.

13. The upholstered furniture device according to claim 10, wherein the height adjustment device comprises a manually operable adjustment means for adjusting the height position of the plate and for adjusting the pressure force, in particular a screw supported in/in a crossbar arranged under the plate.

14. The upholstered furniture device according to claim 10, wherein a manually operable adjusting means of the height adjustment device has a free end by means of which a force application point for transmitting the pressure/pre-tensioning force from below to the plate is/are defined.

15. The upholstered furniture device according to claim 10, wherein the plate is made of a comparatively hard material, and wherein a manually operable adjusting means acts with its free end directly on the plate for transmitting the pressure/pre-tensioning force from below to the plate: or wherein the plate is made of a comparatively soft material, and wherein a free end of the manually operable adjusting means is defined by a ball head with an enlarged bearing surface and/or is reinforced by an interposed pressure distribution element and coupled to the underside of the plate.

16. The upholstered furniture device according to claim 10, wherein the arrangement of the height adjustment device, in particular of at least one manually operable adjusting means of the height adjustment device, is at least approximately central in the transverse direction or eccentric to at least one side, in particular with an eccentricity in only one direction and optimized in terms of magnitude for ergonomic handling by a person using the upholstered furniture device.

17. The upholstered furniture device according to claim 10, wherein the seat/reclining cushion comprises at least two spring units, namely a first spring unit in the form of an upper cushion made of a resilient material, and at least one further spring unit arranged thereunder, on which a compressive/pre-tensioning force exerted upwardly by the plate acts, in particular with the further spring unit comprising wave springs.

18. The upholstered furniture device according to claim 10, wherein an underpadding is provided on the plate, in particular provided by the elevation attachment body, in particular with a protective cover, in particular over a section of only 50% maximum of the seating/lying surface.

* * * * *